US010294707B2

(12) United States Patent
Söderqvist

(10) Patent No.: US 10,294,707 B2
(45) Date of Patent: May 21, 2019

(54) DOUBLE DOOR WITH INNER BRAKE

(71) Applicant: ASSA ABLOY Entrance Systems AB, Landskrona (SE)

(72) Inventor: Sven-Gunnar Söderqvist, Vallåkra (SE)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 168 days.

(21) Appl. No.: 15/300,243

(22) PCT Filed: Mar. 25, 2015

(86) PCT No.: PCT/EP2015/056343
§ 371 (c)(1),
(2) Date: Sep. 28, 2016

(87) PCT Pub. No.: WO2015/150177
PCT Pub. Date: Oct. 8, 2015

(65) Prior Publication Data

US 2017/0183899 A1 Jun. 29, 2017

(30) Foreign Application Priority Data

Mar. 31, 2014 (SE) ..... 1450381

(51) Int. Cl.
*E05F 5/12* (2006.01)
*E05F 15/611* (2015.01)
(Continued)

(52) U.S. Cl.
CPC ..... *E05F 5/12* (2013.01); *E05F 1/1025* (2013.01); *E05F 3/00* (2013.01); *E05F 15/611* (2015.01)

(58) Field of Classification Search
None
See application file for complete search history.

(56) References Cited

U.S. PATENT DOCUMENTS 5,240,349 A * 8/1993 Kennedy ..... E05F 5/12 405/132
2017/0183898 A1* 6/2017 Soderqvist ..... E05F 5/12

FOREIGN PATENT DOCUMENTS

CN 2617666 5/2004
DE 10 2004 062 763 A1 6/2006
(Continued)

OTHER PUBLICATIONS

First Office Action mailed in CN Application 201580017270.6 dated Aug. 25, 2017 (8 pages).
(Continued)

*Primary Examiner* — Catherine A Kelly
(74) *Attorney, Agent, or Firm* — Wissing Miller LLP

(57) ABSTRACT

Double door system (1) comprising an understriking door leaf (2), an overstriking door leaf (3), a first door operator (11) adapted to move the understriking door leaf (2) between an open and a closed position, a second door operator (12) adapted to move the overstriking door leaf (3) between an open and a closed position and a mechanical brake arrangement (400), wherein the understriking door leaf (2) should be closed before the overstriking door leaf (3) to close the double door, and wherein the mechanical brake arrangement (400) is arranged to brake the movement of the overstriking door leaf (3). Mechanical brake arrangement (400) for controlling the movement of one of the door leafs of a double door system. Door operator system (10) comprising a first door operator (11), a second door operator (12) and a mechanical brake arrangement (400).

19 Claims, 10 Drawing Sheets

(51) Int. Cl.
*E05F 1/10* (2006.01)
*E05F 3/00* (2006.01)

(56) References Cited

FOREIGN PATENT DOCUMENTS

| | | | |
|---|---|---|---|
| DE | 10 2006 028 875 | B3 | 8/2007 |
| DE | 102009004506 | | 7/2010 |
| DE | 10 2013 212 650 | B3 | 8/2014 |
| EP | 1 612 358 | A1 | 1/2006 |
| EP | 1 870 550 | A2 | 12/2007 |
| EP | 1 870 552 | A2 | 12/2007 |
| EP | 1 870 553 | A2 | 12/2007 |

OTHER PUBLICATIONS

International Search Report and Written Opinion dated Jun. 3, 2015 in corresponding International Apriication No. PCT/EP2015/056343.
International-Type Search Report dated Oct. 29, 2014 in corresponding Sweden Priority Application No. 1450381-7.

* cited by examiner

DOUBLE DOOR WITH INNER BRAKE

CROSS-REFERENCE TO RELATED APPLICATIONS

This application is the National Stage entry under 35 U.S.C. § 371 of International Application No. PCT/EP2015/056343 filed on Mar. 25, 2015, published on Oct. 8, 2015 under Publication Number WO 2015/150177 A1, which claims the benefit of priority under 35 U.S.C. § 119 of Sweden Patent Application Number 1450381-7 filed Mar. 31, 2014.

TECHNICAL FIELD

The present invention relates to a double door system comprising an understriking door leaf, an overstriking door leaf and a mechanical brake arrangement comprising a braking means arranged to brake the movement of the overstriking door leaf. The present invention also relates to a mechanical brake arrangement for controlling the movement of one of the door leafs of a double door system. Further, the present invention relates to a door operator system comprising the mechanical brake arrangement.

BACKGROUND ART

Double doors, i.e. doors comprising two door leafs, are in some applications provided with a shoulder mounted on one of the door leafs such that the door leafs overlap. This implies that the door leafs have to be closed in a certain order in order to achieve proper closing of the door. If the shoulder is provided on the side of the door leafs facing the opening direction of the door, the door leaf without the shoulder should be closed first and then the door leaf with the shoulder should be closed. If the shoulder is provided on the side of the door leafs facing the closing direction of the door, the door leaf with the shoulder should be closed first and then the door leaf without the shoulder should be closed. The door leaf that should be closed first is denoted understriking door leaf or passive door leaf. The door leaf that should be closed last is denoted overstriking door leaf or active door leaf.

Proper closing of double doors is of course always important in order to achieve a full closing of the double door, but is in particular important in fire doors. Proper closing of doors is in particular important in fire doors where it is important to e.g. confine smoke and cut off oxygen supply. It is also advantageously to close doors properly to e.g. confine heat or cold or obstruct unauthorized access.

The proper closing order of the door leafs of a double door is in general achieved by blocking the closing motion of the active door leaf when the passive door leaf is open. The closing motion of the active door leaf is blocked by applying a breaking force on the active door leaf when the passive door leaf is open. When the passive door leaf is closed the breaking force is removed and thereby the active door leaf is allowed to close. The braking force is in generally applied on the active door leaf by applying a braking force on a motor shaft of a door operator controlling the opening of the active door leaf.

SUMMARY OF THE INVENTION

One object of the present invention is to obtain proper closing of a double door. One object of the present invention is to obtain confinement of heat or cold in a space to which a double door lead. One object of the present invention is to make unauthorized access to a space to which a double door leads difficult. One object of the present invention is to obtain satisfactory fire safety. One object of the present invention is to restrict spreading of smoke and/or to limit the supply of oxygen to a fire. One object of the present invention is to provide an alternative to existing solutions applying a braking force on the motor shaft. One object of the present invention is to provide an alternative to existing solutions applying a braking force on the motor shaft.

These and further objects are achieved by a double door system comprising an understriking door leaf and an overstriking door leaf, wherein the understriking door leaf (2) should be closed before the overstriking door leaf (3) to close the double door. The double door system also comprises a first door operator adapted to move the understriking door leaf between an open and a closed position, and a second door operator adapted to move the overstriking door leaf between an open and a closed position. The double door system further comprises a mechanical brake arrangement. The mechanical brake arrangement is arranged to brake the movement of the overstriking door leaf and comprises a brake drum connected to the second door operator, a braking means arranged to interact with the inside of the brake drum, and a first controlling means. The first controlling means is mechanically operated and arranged to control the braking of the braking means in relation to the position of the understriking door leaf.

The double door system of the present invention achieves proper closing of a double door. The double door system of the present invention achieves confinement of heat or cold in a space to which the double door leads. The double door system of the present invention makes unauthorized access to a space to which the double door leads difficult. The double door system of the present invention achieves satisfactory fire safety. The double door system of the present invention restricts spreading of smoke and/or limits the supply of oxygen to a fire. The double door system of the present invention prevents spreading of fire. The present invention provides an alternative to existing solutions applying a braking force on the motor shaft. The double door system of the present invention enables an improved design being more robust and reliable. The double door system of the present invention is more compact than existing solutions and thus saves space.

The above and further objects are also achieved by a mechanical brake arrangement for controlling the movement of one of the door leafs of a double door system. The double door system comprises an understriking door leaf and an overstriking door leaf, where the understriking door leaf should be closed before the overstriking door leaf to close the double door. The mechanical brake arrangement is adapted to brake the movement of the overstriking door leaf. The mechanical brake arrangement comprises a brake drum adapted to be connected to the overstriking door leaf, a braking means arranged to interact with the inside of the brake drum, and a first controlling means. The first controlling means is mechanically operated and arranged to control the braking of the braking means in relation to the position of the understriking door leaf.

The above and further objects are also achieved by a door operator system comprising a first door operator adapted to move an understriking door leaf between an open and a closed position, a second door operator adapted to move an overstriking door leaf between an open and a closed position and a mechanical brake arrangement according to above.

Further objects and features of the present invention will appear from the following detailed description of embodiments of the invention.

BRIEF DESCRIPTION OF THE DRAWINGS

The invention will be described in more detail with reference to the accompanying drawings, in which.

DETAILED DESCRIPTION

Figure 1:
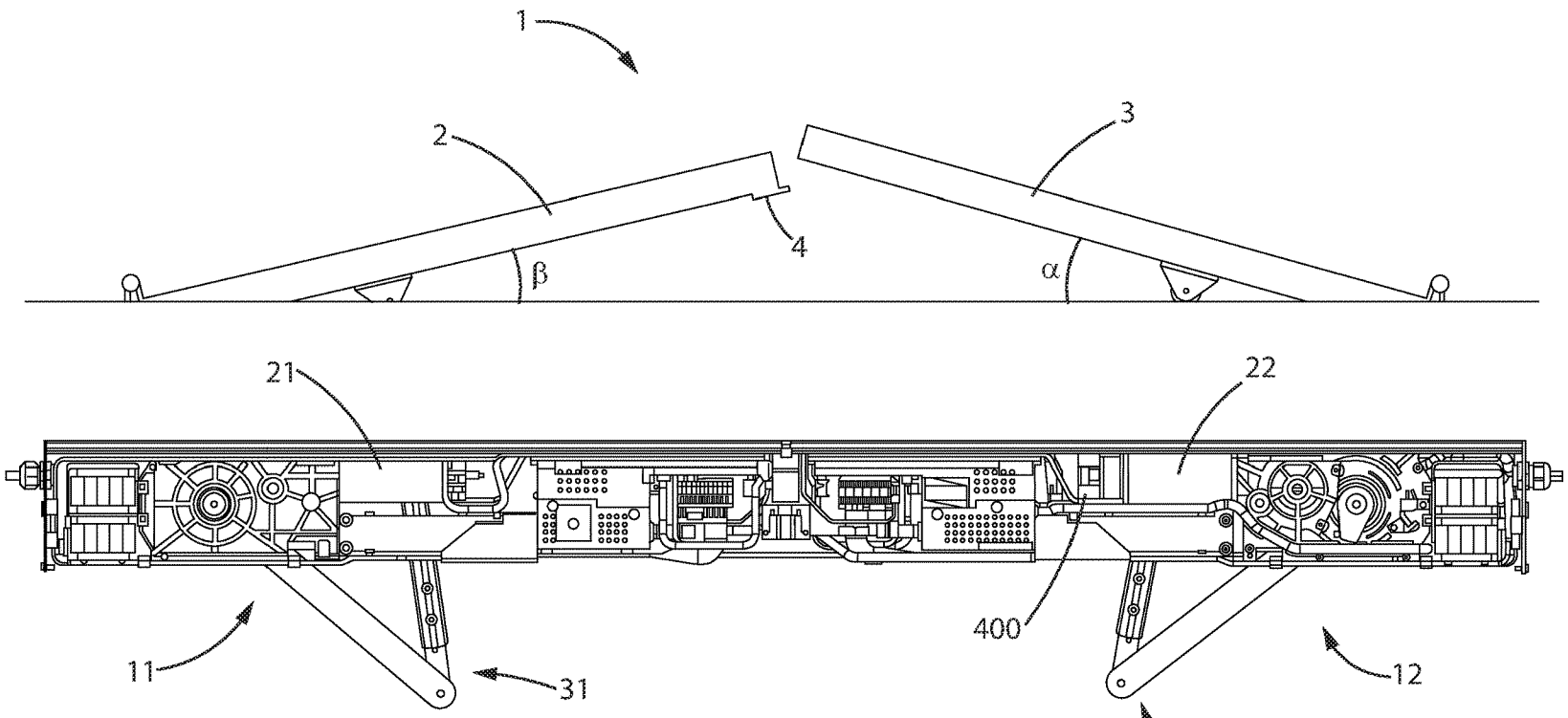
FIG. 1 is a top view of an embodiment of a double door system according to the present invention.

As stated above, the present invention relates to a double door system (1) comprising an understriking door leaf (2), an overstriking door leaf (3), a first door operator (11) adapted to move the understriking door leaf (2) between an open and a closed position, a second door operator (12) adapted to move the overstriking door leaf (3) between an open and a closed position and a mechanical brake arrangement (400), wherein the understriking door leaf (2) should be closed before the overstriking door leaf (3) to close the double door, and wherein the mechanical brake arrangement (400) is arranged to brake the movement of the overstriking door leaf (3) and comprises a brake drum (407) connected to the second door operator (12), a braking means (401, 402) arranged to interact with the inside of the brake drum (407), and a first controlling means (403), which is mechanically operated and arranged to control the braking of the braking means (401, 402) in relation to the position of the understriking door leaf (2). One such double door system is shown in FIG. 1 and details thereof are shown in FIGS. 2-10.

In order to close the double doors properly, the understriking door leaf should be closed or almost closed before the overstriking door leaf is moved into its closed position. The first controlling means controls the braking action of the braking means and thereby also the movement of the overstriking door leaf based on the position of the understriking door leaf. Proper closing of the double door results in confinement of heat or cold in a space to which the double doors lead. Proper closing also makes unauthorized access difficult. Further, proper closing improves the fire safety by restricting spreading of smoke and limit the supply of oxygen to a fire. Since the first controlling means controls the braking action of the braking means and thereby also the movement of the overstriking door leaf based on the position of the understriking door leaf, the braking means can keep the overstriking door leaf opened until the understriking door leaf is closed or almost closed. The mechanical brake arrangement is arranged to coordinate the closing of the door leafs such that the understriking door leaf is closed before the overstriking door leaf is closed.

One of the door leafs has a shoulder (4) that overlaps the other door leaf. In one aspect, the understriking door (2) leaf is provided with a shoulder (4) that overlaps the overstriking door leaf (3) (see FIG. 1). The shoulder is then provided on the side of the understriking door leaf facing the closing direction of the understriking door leaf. In an alternative aspect, the overstriking door leaf is provided with a shoulder that overlaps the understriking door leaf (not shown). The shoulder is then provided on the side of the overstriking door leaf facing the opening direction of the overstriking door leaf. A double door comprising a shoulder is sometimes called a rebated door. A double door comprising two door leafs is sometimes called a dual door.

The mechanical brake arrangement (400) is mechanically operated. No electrical supply is needed for the proper operation of the mechanical brake arrangement. Therefore, the mechanical brake arrangement is operable without power. Thus, the mechanical brake arrangement is operable in a powerless condition. The braking means (401, 402) is arranged to mechanically brake the movement of the overstriking door leaf (3). The first controlling means (403) is mechanically operated. The first controlling means (403) is arranged to mechanically control the braking of the braking means (401, 402) in relation to the position of the understriking door leaf (2). The braking means (401, 402) is arranged to brake the movement of the overstriking door leaf (3) in a powerless condition. The first controlling means (403) is arranged to control the braking of the braking means (401, 402) in relation to the position of the understriking door leaf (2) in a powerless condition.

The mechanical brake arrangement comprises a brake drum (407) and the braking means (401, 402) interact with the inside of the brake drum (407). Thus, the braking action of the mechanical brake arrangement is achieved by action of the braking means (401, 402) on the inside of the brake drum (407). By having braking means being arranged to interact with the inside of the brake drum (407), the dimension, and in particular the diameter, of the mechanical brake arrangement can be reduced, e.g. compared to braking means acting from the outside. The braking means can at least partly be arranged radially inwards of the brake drum. Interaction of the braking means with the inside of the brake drum achieves a more reliable mechanical brake arrangement having a longer operating life time. One reason is that a stronger and more stable design can be employed when a braking means is to be separated from the inside of the brake drum. One further reason is that interaction of the braking means with the inside of the brake drum also enables and facilitates use of a compression spring to put the braking means in a braking state when the braking means is in a passive position, i.e. not affected by the controlling means. To put braking means acting from the outside in a braking state when the braking means is in a passive position usually a tension spring is used. A compression spring is more reliable and has a longer endurance, e.g. due to that a compression spring can be successfully subjected to surface treatment, such as ball-bombardment. The braking means act (401, 402) on the inside of the brake drum (407). The braking means (401, 402) abuts the drum (407) in a braking state. The braking means (401, 402) is separated from the drum in a non-braking state.

In one aspect, the braking means (401, 402) comprises a braking portion (431, 432) located radially inwards of the brake drum (407) and acting radially outwards on the brake drum (407). Thereby interaction of the braking means with the inside of the brake drum is easily obtained. Arranging a braking portion radially inwards of the brake drum enables and facilitates a compact design and in particular a reduced diameter of the brake arrangement.

In one aspect, the braking means (401, 402) comprises a lever portion (411, 412) extending radially outside of the brake drum (407), on which lever portion (411, 412) the first controlling means (403) acts. By having a lever portion extending radially outside of the brake drum, on which lever portion the controlling means acts implies a long distance from the point of abutment between the braking means and the brake drum, which point of abutment is located on the inside of the brake drum, to the point of action of the controlling means on the braking means. Thereby, a long lever arm is obtained which increases the braking force of the braking means on the brake drum transmitted from the controlling means to the braking means.

In one aspect, the braking means (401, 402) comprises a pivot axis (413, 414) about which the braking means (401, 402) pivots, wherein the pivot axis is located radially outside of the brake drum (407). By having a pivot axis about which the braking means pivots located radially outside of the brake drum implies a long distance from the point of abutment between the braking means and the brake drum, which point of abutment is located on the inside of the brake drum, to the pivot axis of the braking means. Thereby, a long lever arm is obtained which increases the braking force of the braking means on the brake drum, e.g. the force transmitted from the controlling means to the braking means.

The braking means (401, 402) may comprise a pivot pin (415, 416), about which pivot pin (415, 416) the braking means (401, 402) pivots, wherein the pivot pin is located radially outwards of the brake drum (407). The longitudinal direction of the pivot pin of the braking means coincides with the pivot axis of the braking means. The braking means (401, 402) may comprise a pivot portion (417, 418) comprising the pivot pin (415, 416). The pivot portion of the braking means is located radially outwards of the brake drum (407). The pivot portion of the braking means as well as the pivot pin of the braking means may be located axially outwards of the brake drum (407).

In one aspect, the first controlling means (403) is arranged to put the braking means (401, 402) in a non-braking state when the understriking door leaf (2) is in a closed condition. By putting the braking means in a non-braking state when the understriking door leaf is in a closed condition, the overstriking door leaf is allowed to move in the closing direction, and into its closed position, when the understriking door leaf is in closed condition.

The closed condition of the understriking door leaf as used herein is meant to include a fully closed position and positions close to a fully closed position of the understriking door leaf, such as positions where a second angle (β) between the understriking door leaf and the fully closed position of the understriking door leaf is between about 0° and about 2°.

In one aspect of a mechanical brake arrangement having a first controlling means (403) but no second controlling means as defined herein, the first controlling means (403) is arranged to put the braking means (401, 402) in a braking state when the understriking door leaf (2) is in an opened condition. Thereby, the movement of the overstriking door leaf in the closing direction is braked when the understriking door leaf is in an opened condition, i.e. in a position outside the closed condition of the understriking door leaf. Thus, the overstriking door leaf is not allowed to move in the closing direction when the understriking door leaf is opened.

The opened condition of the understriking door leaf as used herein is meant to include a fully opened position and opened positions except those positions included in the closed condition of the understriking door leaf, such as positions where the angle (β) between the understriking door leaf and the fully closed position of the understriking door leaf is more than about 2°.

In one aspect of a mechanical brake arrangement having a first controlling means (403) but no second controlling means as defined herein, the first controlling means (403) is movable between a braking position and a non-braking position, wherein the braking means (401, 402) is in the non-braking state when the first controlling means (403) is in the non-braking position, and wherein the braking means (401, 402) is in the braking state when the first controlling means (403) is in the braking position. Since the braking means is in the non-braking state when the first controlling means is in its non-braking position, the overstriking door leaf is allowed to move in the closing direction when the first controlling means is in its non-braking position. Since the braking means is in the braking state when the first controlling means is in its braking position, the movement of the overstriking door leaf in the closing direction is braked when the first controlling means is in its braking position. The state of the braking means and thus also the braking action of the braking means is dependent on the position of the first controlling means. In one aspect, the first controlling means is in the non-braking position when the understriking door leaf is in the closed condition as defined above. In one aspect, the first controlling means is in the braking position when the understriking door leaf is in the opened condition as defined above.

In one aspect, the mechanical brake arrangement (400) comprises a brake spring (405) pushing the braking means (401, 402) towards the brake drum (407). By having braking means interacting with the inside of the brake drum and being pushed towards the brake drum by the brake spring, a more reliable mechanical brake arrangement having a longer operating life time is achieved, e.g. due to that use of a compression spring thereby is facilitated. A compression spring is more reliable and has a longer endurance than for example a tension spring, e.g. since a compression spring can be successfully subjected to surface treatment, such as ball-bombardment. The brake spring (405) may push the braking means (401, 402) radially outwards towards the brake drum (407). The brake spring (405) may be a compression spring (405). The brake spring (405) may be a coil spring (405), also named a helical spring.

In one aspect, the first controlling means (403) is arranged to separate the braking means (401, 402) from the brake drum (7). Thereby, the braking action of the braking means is removed by the first controlling means. The braking means (401, 402) may be separated from the brake drum (7) by pushing the braking means radially inwards. The first controlling means (403) is arranged to separate the braking means (401, 402) from the brake drum (7) when the understriking door leaf is in a closed condition.

In one aspect, the mechanical brake arrangement (400) comprises a second controlling means (404), which is mechanically operated and arranged to control the braking of the braking means (401, 402) in relation to the position of the overstriking door leaf (3). The second controlling means controls the braking means and thereby also the movement of the overstriking door leaf based on the position of the overstriking door leaf. The movement of the overstriking door leaf can thereby be based on both the position of the understriking door leaf and the position of the overstriking door leaf. The overstriking door leaf does not have to stand still and wait until the understriking door leaf is in its closed position, but instead the overstriking door leaf can start its movement earlier and thereby a rapid closing of the double doors are achieved. A rapid closing of the double door results in improved confinement of heat or cold in a space to which the double doors lead. Rapid closing also makes unauthorized access more difficult. Further, rapid closing improves the fire safety by restricting spreading of smoke and limit the supply of oxygen to a fire. Since the second controlling means controls the braking means and thereby also the movement of the overstriking door leaf based on the position of the overstriking door leaf, the overstriking door leaf can be allowed to move in the closing direction as long as the overstriking door leaf does not obstruct the closing of the understriking door leaf.

The second controlling means (404) is mechanically operated. The second controlling means (404) is arranged to mechanically control the braking of the braking means (401, 402) in relation to the position of the overstriking door leaf (3). The second controlling means (404) is arranged to mechanically control the braking of the braking means (401, 402) in relation to the position of the overstriking door leaf (3) in a powerless condition.

In one aspect, the second controlling means (404) is arranged to put the braking means (401, 402) in a non-braking state when the overstriking door leaf (3) is in a first opened state, which first opened state corresponds to a position of the overstriking door leaf (3) having an angle (a) in relation to a closed position of the overstriking door leaf (3) that is larger than a predetermined angle. By putting the braking means in a non-braking state when the overstriking door leaf is in the first opened state, the overstriking door leaf is also allowed to move in the closing direction when the overstriking door leaf is opened to a certain extent. The overstriking door leaf is thereby allowed to move when the overstriking door leaf is in a position between its fully opened position and a position where the overstriking door leaf has a predetermined angle in relation to its fully closed position.

In one aspect of a mechanical brake arrangement having a first controlling means (403) and a second controlling means (404), the first controlling means (403) and the second controlling means (404) are arranged to put the braking means (401, 402) in a braking state when the understriking door leaf (2) is in an opened condition and the overstriking door leaf (3) is in a second opened state, which second opened state corresponds to a position of the overstriking door leaf (3) having an angle ($\alpha$) in relation to a closed position of the overstriking door leaf (3) that is equal to or smaller than said predetermined angle. By putting the braking means in a braking state when the understriking door leaf is in an opened condition and the overstriking door leaf is in the second opened state, the movement of the overstriking door leaf in the closing direction is braked when the overstriking door leaf is in a region around its closed position and when the understriking door leaf at the same time is in an opened condition, i.e. in a position outside the closed condition of the understriking door leaf. Thereby, the closing of the understriking door leaf may be unobstructed by the overstriking door leaf.

In one aspect, the predetermined angle is set such that the understriking door leaf (2) could be moved into its closed position without interfering with the overstriking door leaf (3) when the angle ($\alpha$) of the overstriking door leaf (3) is equal to or larger than the predetermined angle. Thereby, the understriking door leaf can be moved from an opened position to its closed position without interfering with the overstriking door leaf. The overstriking door leaf is allowed to move in the closing direction when the angle of the overstriking door leaf is larger than the predetermined angle, i.e. when the overstriking door leaf does not interfere with the understriking door leaf. The movement of the overstriking door leaf in the closing direction is allowed when the overstriking door leaf do not risk interfering with the understriking door leaf during closing of the understriking door leaf. The movement of the overstriking door leaf in the closing direction is braked when the angle of the overstriking door leaf is equal to or smaller than the predetermined angle, i.e. when the overstriking door leaf interferes with the understriking door leaf. The movement of the overstriking door leaf in the closing direction is braked when the overstriking door leaf risk interfering with the understriking door leaf during closing of the understriking door leaf. The predetermined angle is preferably set such that a margin is included in relation to the angle $\alpha$ where the understriking door leaf only barely could be moved into its closed position without interfering with the overstriking door leaf. In one aspect, the predetermined angle is in the range 8° to 60°, such as 10° to 45°, such as 10° to 30°, such as 15° to 20°.

In one aspect of a mechanical brake arrangement having a first controlling means (403) and a second controlling means (404), the first controlling means (403) is movable between a braking position and a non-braking position and the second controlling means (404) is movable between a braking position and a non-braking position, wherein the braking means (401, 402) is in the non-braking state when any one or both of the first controlling means (403) and the second controlling means (404) is in their respective non-braking position, and wherein the braking means (401, 402) is in the braking state when both of the first controlling means (403) and the second controlling means (404) are in their respective braking positions. Since the braking means is in the non-braking state when the first controlling means is in its non-braking position or when the second controlling means is in its non-braking position or when both the first controlling means is in its non-braking position and the second controlling means is in its non-braking position, the overstriking door leaf is allowed to move in the closing direction when any one or both of the first and second controlling means are in their respective non-braking positions. Since the braking means is in the braking state when both the first controlling means is in its braking position and the second controlling means is in its braking position, the movement of the overstriking door leaf in the closing direction is braked when both of the first and second controlling means are in their respective braking positions. The state of the braking means and thus also the braking action of the braking means is dependent on the position of both of the first and second controlling means. Any one of the first and second controlling means can put the braking means in the non-braking state, but in order to have the braking means in the braking state both the first and the second controlling means have to be in their braking positions. In one aspect, the first controlling means is in the non-braking position when the understriking door leaf is in the closed condition as defined above. In one aspect, the first controlling means is in the braking position when the understriking door leaf is in the opened condition as defined above. In one aspect, the second controlling means is in the non-braking position when the overstriking door leaf is in the first opened state as defined above. In one aspect, the second controlling means is in the braking position when the overstriking door leaf is in the second opened state as defined above.

The first door operator (11) is connected to and adapted to move the understriking door leaf (2) between an open and a closed position. The second door operator (12) is connected to and adapted to move the overstriking door leaf (3) between an open and a closed position.

The mechanical brake arrangement (400) is arranged to control the movement of the overstriking door leaf of a double door system.

The first and second door operators may be arranged to push the door leafs in the opening direction (shown in FIGS. 1-4) or to pull the door leafs in the opening direction.

In one aspect, the second door operator (12) comprises a second moving part (14), which moves in relation to the position of the overstriking door leaf (3), and the second controlling means (404) is coupled to the second moving part (14) such that the second moving part (14) moves the second controlling means (404) between a braking position and a non-braking position. Thereby, the control of the movement of the overstriking door leaf is based on the movement of the second moving part. The movement of the second moving part is in its turn dependent on the position of the overstriking door leaf.

In one aspect, the second door operator (12) comprises a second moving part (14), which moves in relation to the position of the overstriking door leaf (3). The second controlling means (404) may be coupled to the second moving part (14) such that the second moving part (14) moves the second controlling means (404) in relation to the position of the overstriking door leaf (3). In one aspect, the second controlling means (404) is mechanically coupled to the second moving part (14).

In one aspect, the second controlling means (404) is arranged to be coupled to a second moving part (14) of a second door operator (12) of the overstriking door leaf (3), which second moving part (14) moves in relation to the position of the overstriking door leaf (3), such that the second moving part (14) moves the second controlling means (404) in relation to the position of the overstriking door leaf (3). In one aspect, the second controlling means (404) is arranged to be mechanically coupled to the second moving part (14).

Figure 2:
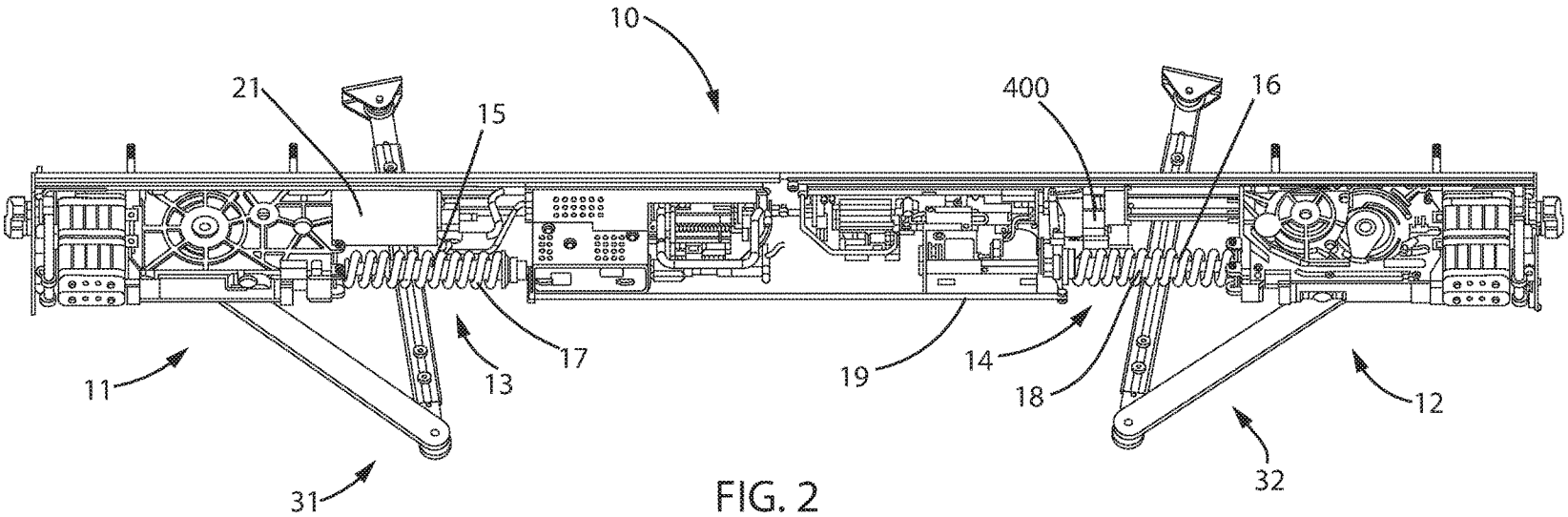
FIG. 2 is a top view of an embodiment of a door operator system according to the present invention.
Figure 3:
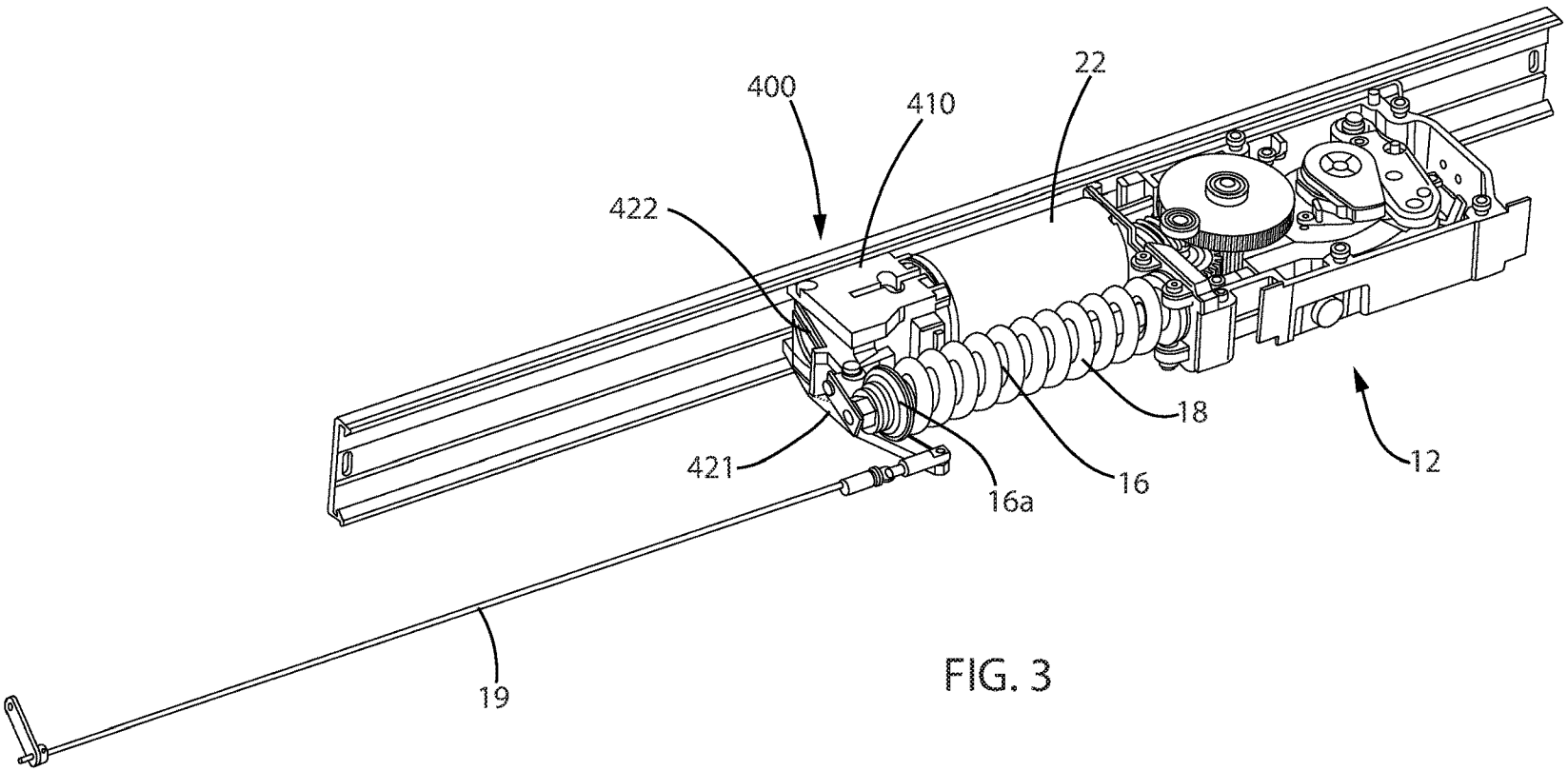
FIG. 3 is a perspective view of an embodiment of a second door operator according to the present invention.

In one aspect, the second moving part (14) is a second spring arrangement (14). The second moving part may also be a second door operator arm (similar to 32 in FIG. 1) or any other part of the second door operator that moves in relation to the position of the overstriking door leaf. In one aspect, the second moving part is a second spring rod (16) of a second spring arrangement (14) as shown in FIGS. 2 and 3. In one aspect, the second spring rod (16) compresses a second spring (18) when the overstriking door leaf (3) is opened. The spring load stored in the compressed second spring (18) may move the overstriking door leaf (3) in the closing direction.

In one aspect, the first door operator (11) comprises a first moving part (13), which moves in relation to the position of the understriking door leaf (2), and the first controlling means (403) is coupled to the first moving part (13) such that the first moving part (13) moves the first controlling means (403) between a braking position and a non-braking position. Thereby, the control of the movement of the understriking door leaf is based on the movement of the first moving part. The movement of the first moving part is in its turn dependent on the position of the understriking door leaf.

In one aspect, the first door operator (11) comprises a first moving part (13), which moves in relation to the position of the understriking door leaf (2). The first controlling means (403) may be coupled to the first moving part (13) such that the first moving part (13) moves the first controlling means (403) moves in relation to the position of the understriking door leaf (2). In one aspect, the first controlling means (403) is mechanically coupled to the first moving part (13).

In one aspect, the first controlling means (403) is arranged to be coupled to a first moving part (13) of a first door operator (11) of the understriking door leaf (2), which a first moving part (13) moves in relation to the position of the understriking door leaf (2), such that the first moving part (13) moves the first controlling means (403) in relation to the position of the understriking door leaf (2). In one aspect, the first controlling means (403) is arranged to be mechanically coupled to the first moving part (13).

Figure 4:
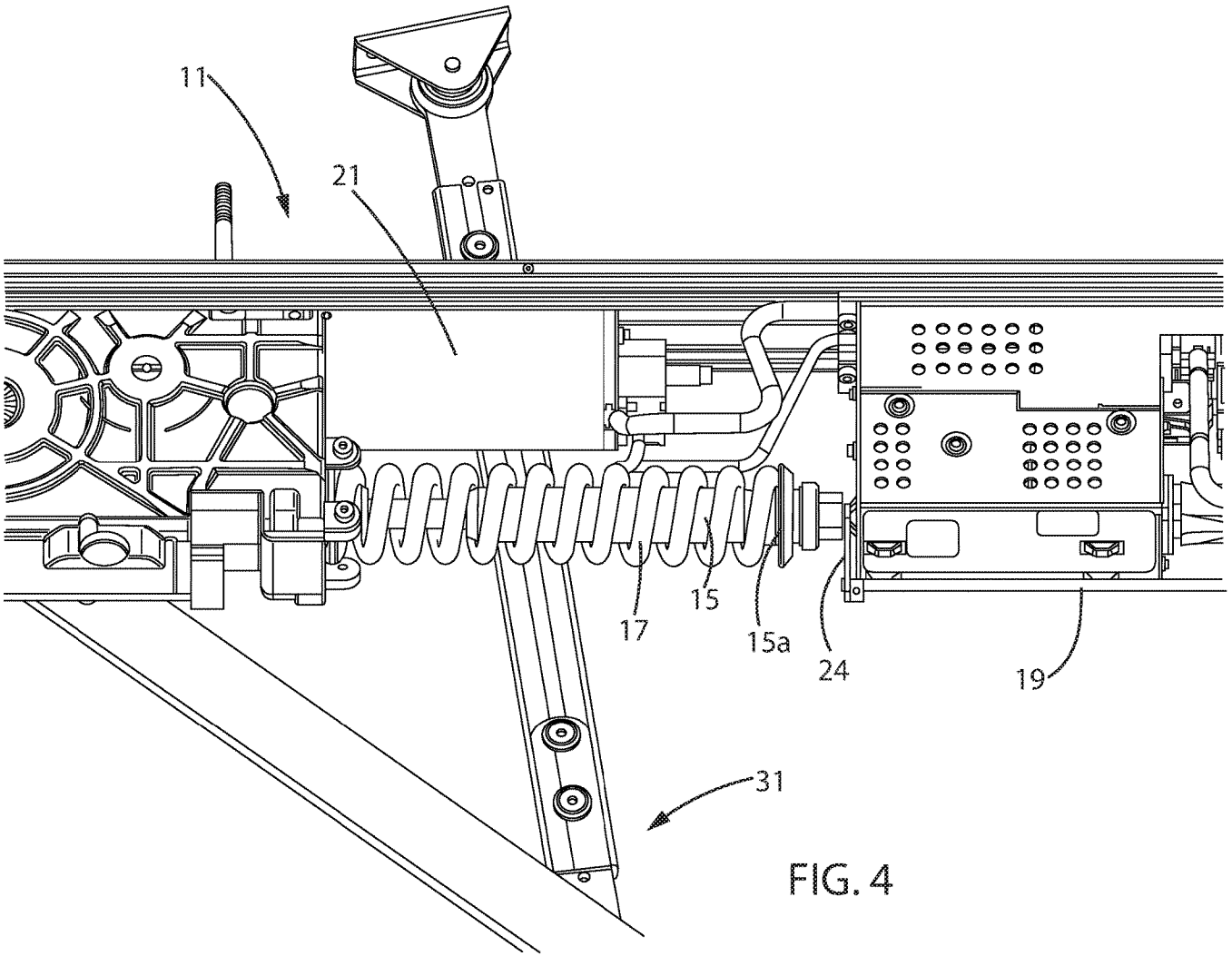
FIG. 4 is a perspective view of an embodiment of a first door operator according to the present invention.
Figure 5:
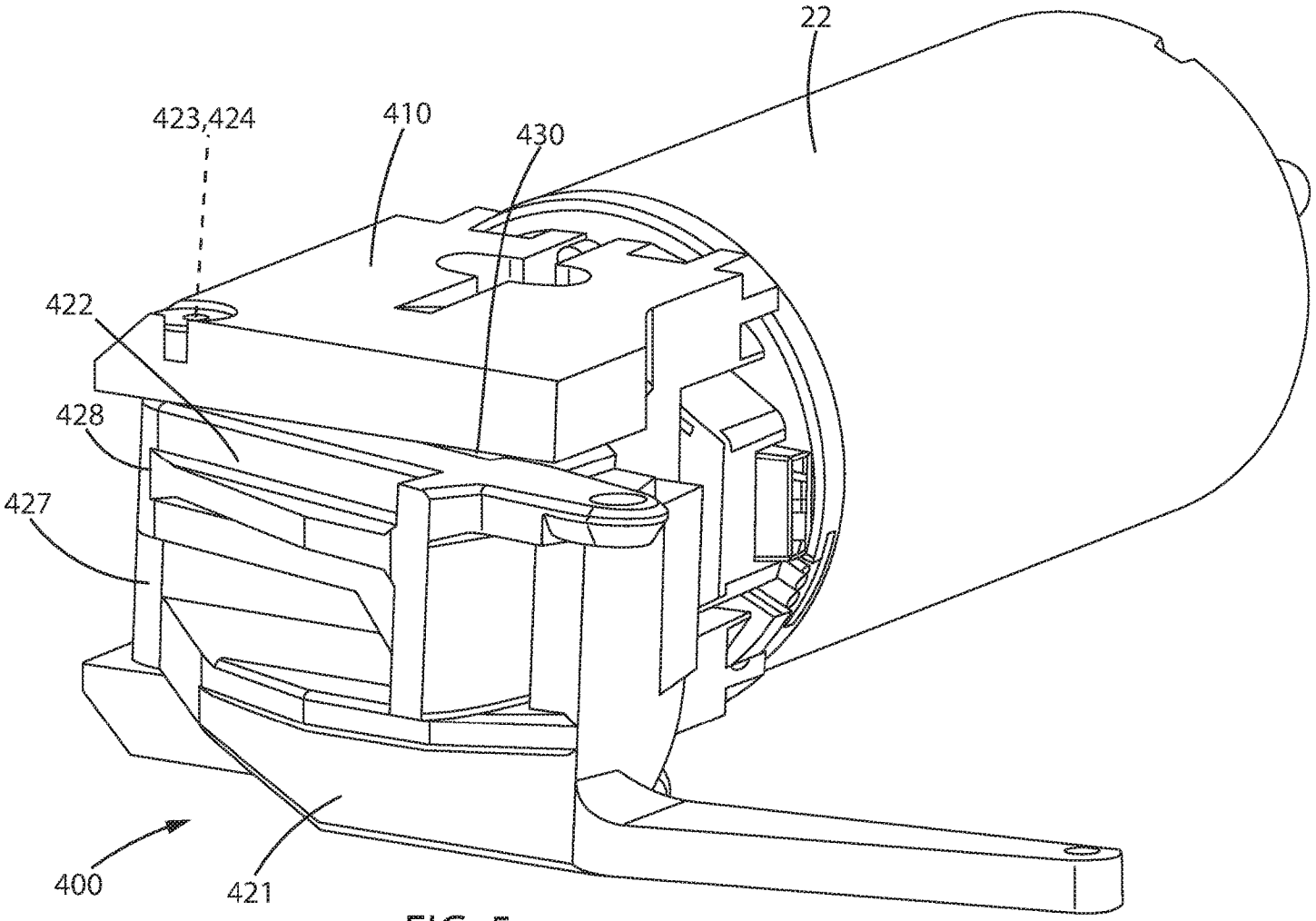
FIG. 5 is a perspective view of an embodiment of a mechanical brake arrangement according to the present invention.
Figure 6:
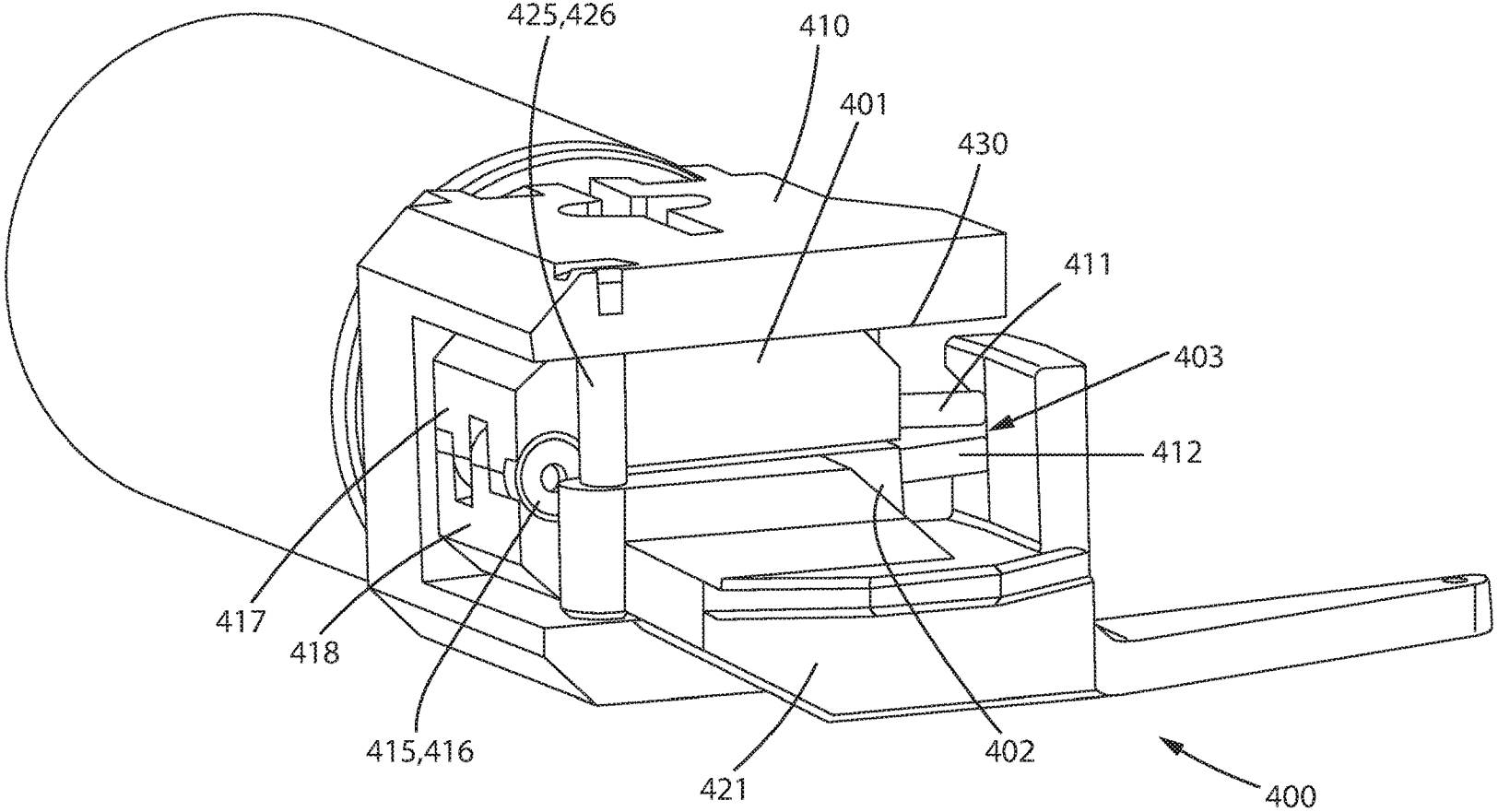
FIG. 6 is a perspective view of the embodiment of a mechanical brake arrangement shown in FIG. 3, where a second control lever has been removed.
Figure 7:
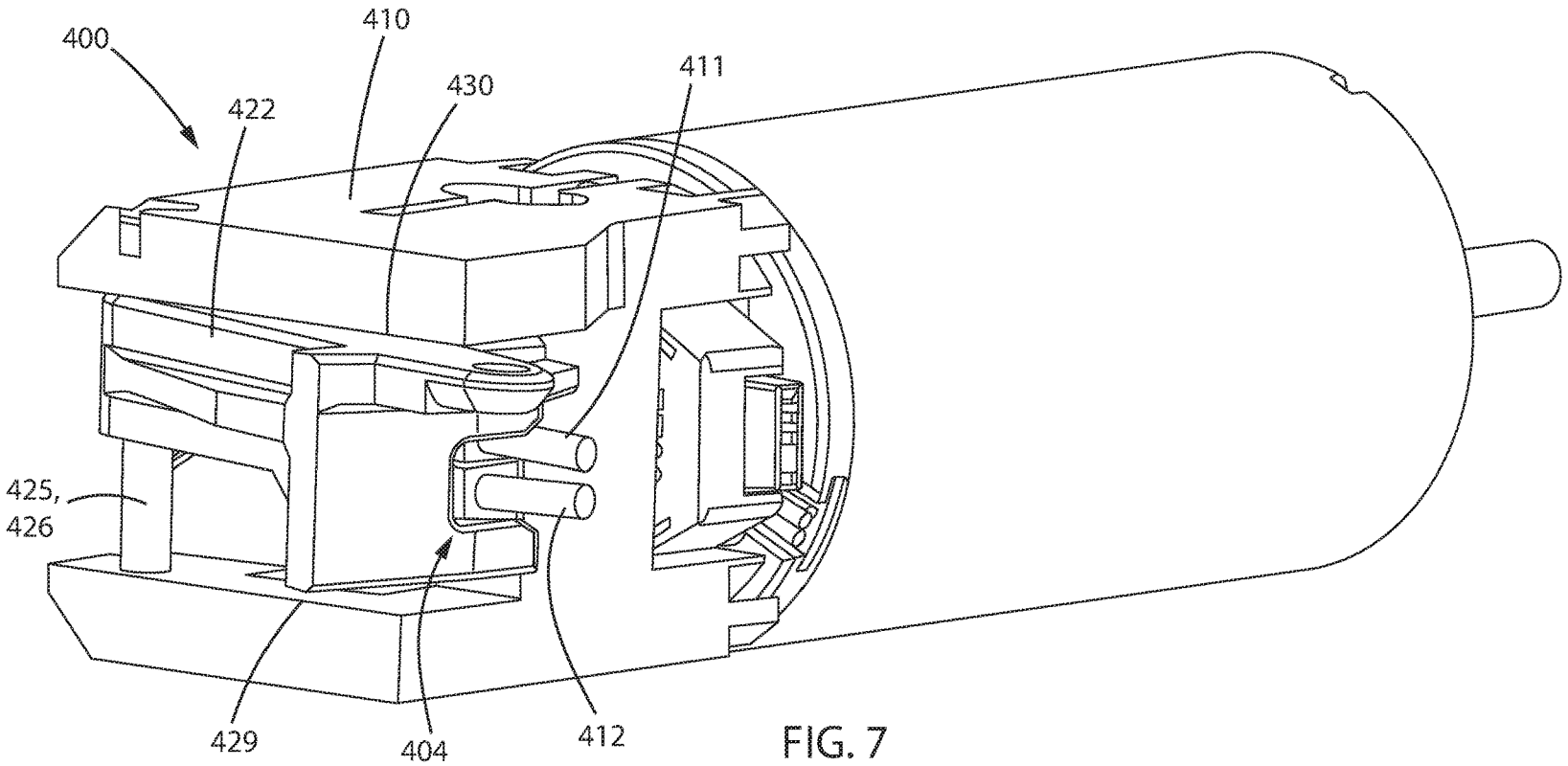
FIG. 7 is a perspective view of the embodiment of a mechanical brake arrangement shown in FIG. 3, where a first control lever has been removed.
Figure 8:
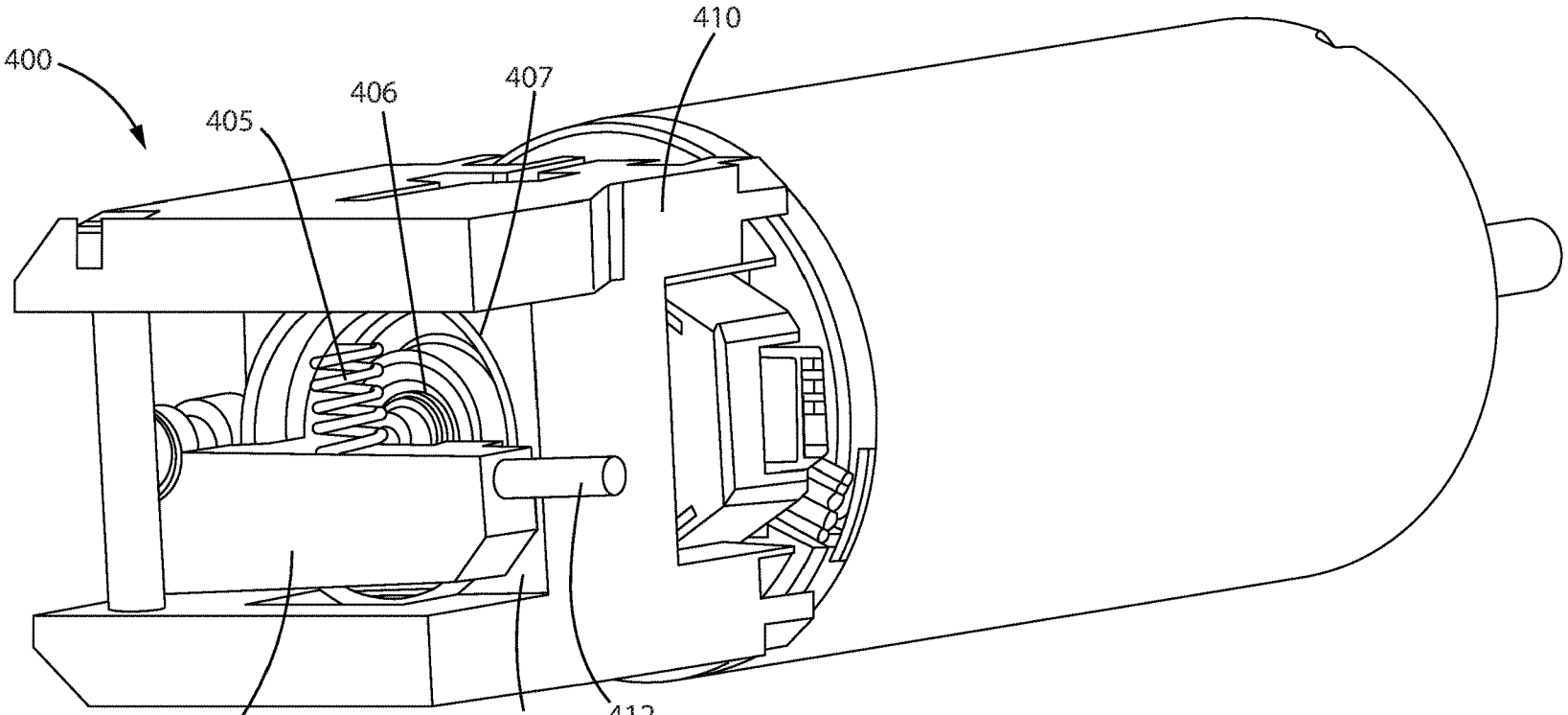
FIG. 8 is a perspective view of the embodiment of a mechanical brake arrangement shown in FIG. 3, where a first control lever, a second control lever and a braking means have been removed.
Figure 9:
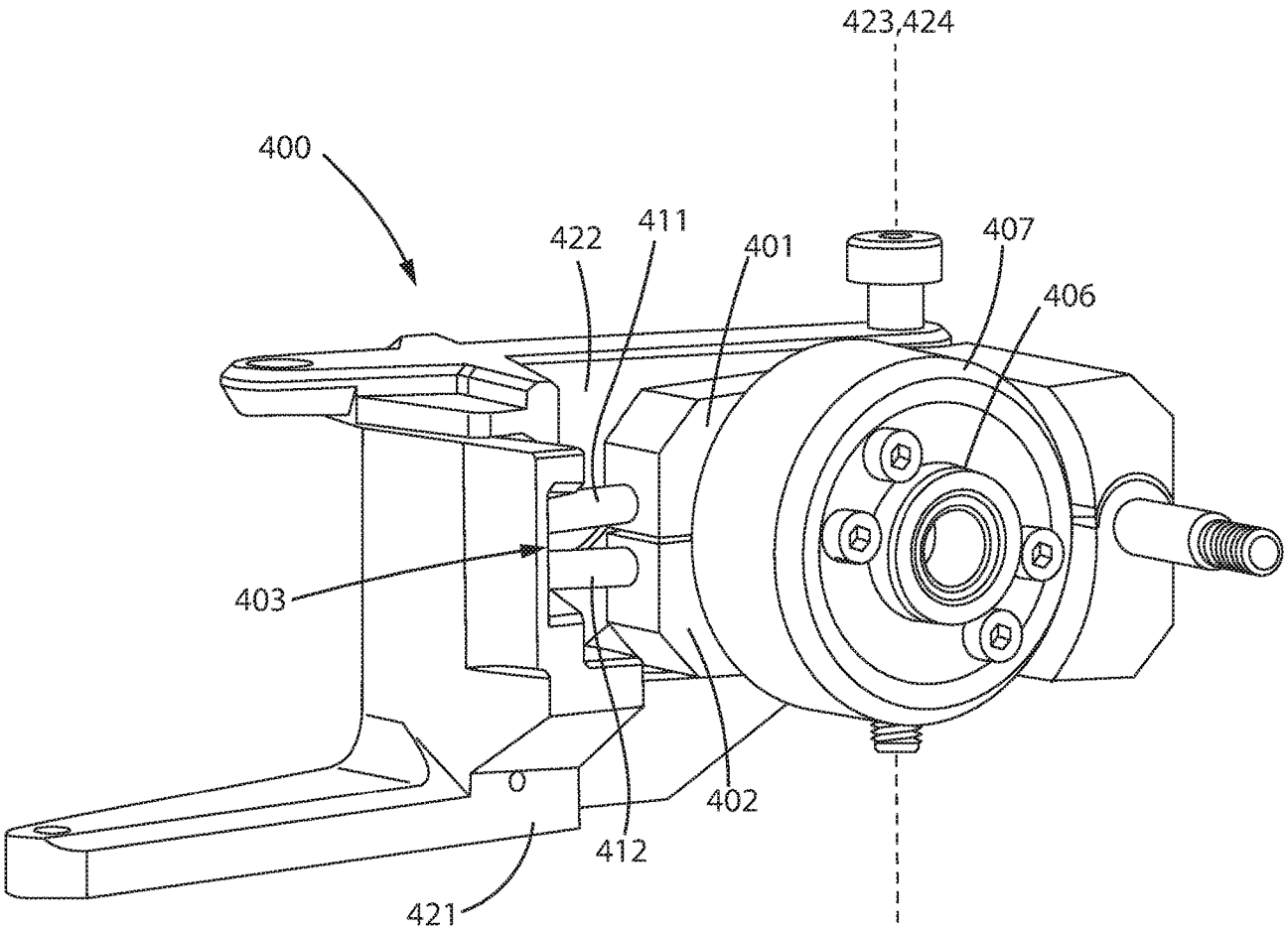
FIG. 9 is a perspective view of the embodiment of a mechanical brake arrangement shown in FIG. 3, where a support structure has been removed.
Figure 10:
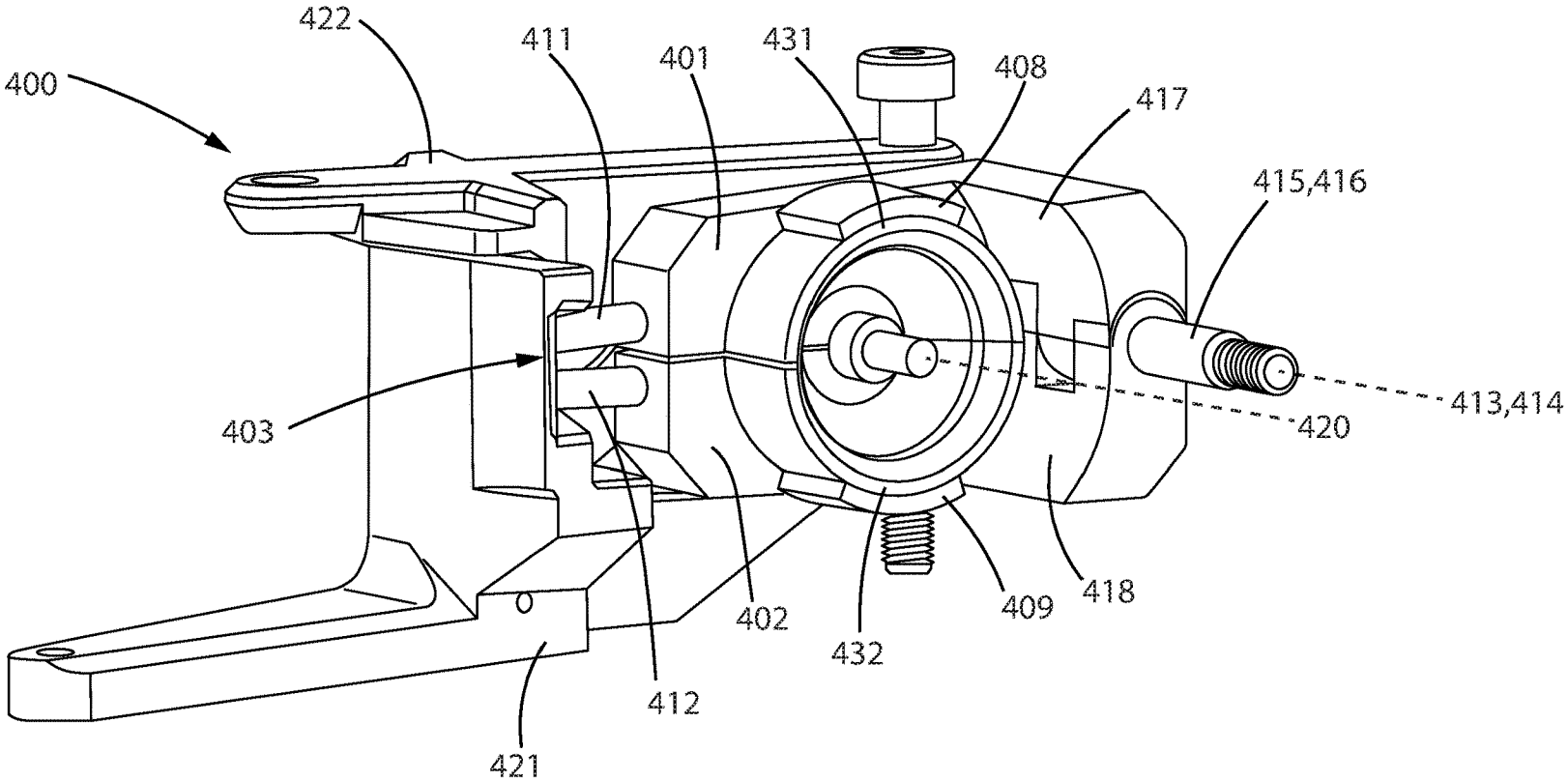
FIG. 10 is a perspective view of the embodiment of a mechanical brake arrangement shown in FIG. 3, where a support structure, a brake drum and a one-way clutch have been removed.

In one aspect, the first moving part (13) is a first spring arrangement (13). The first moving part may also be a first door operator arm (similar to 31 in FIG. 1) or any other part of the first door operator that moves in relation to the position of the understriking door leaf. In one aspect, the first moving part (13) is a first spring rod (15) of a first spring arrangement (13) as shown in FIG. 4. In one aspect, the first spring rod (15) compresses a first spring (17) when the understriking door leaf (2) is opened. The spring load stored in the compressed first spring (17) may move the understriking door leaf (2) in the closing direction.

In one aspect, the mechanical brake arrangement comprises a first control lever (421) comprising the first controlling means (403). The first controlling means (403) may be integrated in the first control level (421).

In one aspect, the mechanical brake arrangement comprises a second control lever (422) comprising the second controlling means (404). The second controlling means (404) may be integrated in the second control level (422).

In one aspect, the first controlling means (403) is coupled to the first moving part (13) by means of a first position transferring means (19). The first position transferring means (19) may be a position transferring rod (19) or a wire. In one aspect, the first spring rod (15) is connected to the first position transferring means (19) by means of a first connector (24). In one aspect, the first position transferring means (19) is connected to the first controlling means (403) by means of the first control lever (421).

In one aspect, the second controlling means (404) is coupled to the second moving part (14) by means of the second control lever (422). The second spring rod (16) may be connected to the second controlling means (404) by means of the second control lever (422).

In one aspect, the braking means (401, 402) has a passive position and an active position, wherein the braking means (401, 402) is in its braking state in the passive position and the braking means (401, 402) is in its non-braking state in the active position. Thereby, the braking means applies a braking action in its passive position. The passive position corresponds to the resting state of the braking means. The braking means may be in its passive position when the braking means is unaffected by brake controlling means, such as the first controlling means and the second controlling means. The braking means may be in its active position when the braking means is affected by brake controlling means, such as any or both of the first and second controlling means. In one aspect, the braking means may automatically be brought to its passive position when the braking means becomes unaffected by brake controlling means. In one aspect, the braking means may automatically return from its active position to its passive position when the braking means has been affected by brake controlling means and becomes unaffected by brake controlling means.

In one aspect, the passive position of the braking means (401, 402) is obtained by the brake spring (405). The brake spring may force the braking means into the braking state of the braking means when the braking means is unaffected. The spring may also bring the braking means into the braking state when the braking means becomes unaffected by brake controlling means.

In one aspect, the braking means (401, 402) is unaffected by the first controlling means (403) and the second controlling means (404) in the passive position. In one aspect, the braking means (401, 402) is affected by the first controlling means (403) and/or the second controlling means (404) in the active position.

In one aspect, the first controlling means (403) and the second controlling means (404) are arranged to mechanically move the braking means (401, 402) from its passive position to its active position. Thereby, the first controlling means and the second controlling means mechanically control the position of the braking mans. The first and second controlling means are thereby arranged to put the braking means in the non-braking state. The first and second controlling means are arranged to move the braking means from the braking state to the non-bra king state.

In one aspect, the first controlling means (403) is arranged to move the braking means (401, 402) to the active state when the understriking door leaf (2) comes into the closed condition as defined above. In one aspect, the second controlling means (404) is arranged to move the braking means (401, 402) to the active state when the overstriking door leaf (3) comes into the first opened state as defined above. In one aspect, the first controlling means (403) is arranged to move the braking means (401, 402) from the passive state to the active state when the understriking door leaf (2) is moved to the closed condition as defined above. In one aspect, the second controlling means (404) is arranged to move the braking means (401, 402) from the passive state to the active state when the overstriking door leaf (3) is moved to the first opened state.

In one aspect, the first controlling means (403) and the second controlling means (404) are further arranged to mechanically move the braking means (401, 402) from its active position to its passive position. Thereby, the first controlling means and the second controlling means mechanically control the position of the braking means further. The first and second controlling means are thereby arranged to put the braking means in the braking state. The first and second controlling means are arranged to move the braking means from the non-braking state to the braking state.

In one aspect, the second controlling means (404) is arranged to move the braking means (401, 402) to the passive state when the understriking door leaf (2) is in the opened condition as defined above and the overstriking door leaf (3) comes into the second opened state as defined above, when the overstriking door leaf (3) is in the second opened state and the understriking door leaf (2) comes into the opened condition or when the understriking door leaf (2) comes into the opened condition and the overstriking door leaf (3) comes into the second opened state essentially simultaneously. In one aspect, the second controlling means (404) is arranged to move the braking means (401, 402) from the active state to the passive state when the understriking door leaf (2) is in the opened condition as defined above and the overstriking door leaf (3) is moved to the second opened state as defined above, when the overstriking door leaf (3) is in the second opened state and the understriking door leaf (2) is moved to the opened condition or when the understriking door leaf (2) is moved to the opened condition and the overstriking door leaf (3) is moved to the second opened state essentially simultaneously.

In one aspect, the mechanical brake arrangement (400) is arranged to brake a rotation of a second motor shaft of a second motor (22, 23) of the second door operator (12). Thus, the mechanical brake arrangement (400) is arranged to brake a rotation of a motor shaft of a motor arranged to open the overstriking door leaf (3). In one aspect, the second door operator (12) comprises a second motor (22, 23) having a motor shaft. The second motor (22, 23) of the second door operator (12) may be arranged to open the overstriking door leaf (3). Thereby, the mechanical brake arrangement may be arranged to brake a rotation of a motor shaft of a motor (22, 23) of the second door operator (12), which motor (22, 23) is arranged to open the overstriking door leaf (3). The brake drum (407) may be connected to the motor shaft of the second motor (22, 23). The second motor may be an electric motor. Thus, the second door operator may be an electric door operator.

In one aspect, the first door operator (11) comprises a first motor (21). The first motor (21) of the first door operator (11) may be arranged to open the understriking door leaf (2). The first motor may be an electric motor. Thus, the first door operator may be an electric door operator.

In one aspect, the mechanical brake arrangement (400) is arranged to only affect the movement of the overstriking door leaf (3) in a closing direction of the overstriking door leaf (3).

In one aspect, the mechanical brake arrangement (400) comprises a one-way clutch (406) arranged to transfer any braking action of the braking means (401, 402) to the overstriking door leaf (3) in a closing direction of the overstriking door leaf (3) and to allow movement of the overstriking door leaf (3) in an opening direction of the overstriking door leaf (3) regardless of the state of the braking means (401, 402). Thereby, the mechanical brake arrangement affects the movement of the overstriking door leaf in the closing direction while leaving the movement of the overstriking door leaf unaffected in the opening direction. Thus, the overstriking door leaf can always be moved in the opening direction without being braked by the mechanical brake arrangement. On the other hand the mechanical brake arrangement affects the closing movement of the overstriking door. If the mechanical brake arrangement is in the braking state the movement of the overstriking door leaf in the closing direction is braked. If the mechanical brake arrangement is in the non-braking state the movement of the overstriking door leaf in the closing direction is unbraked by the mechanical brake arrangement. The one-way clutch is arranged to transfer braking action of the braking means to the overstriking door leaf in the closing direction of the overstriking door leaf when the braking means is in the braking state. The one-way clutch is arranged to allow movement of the overstriking door leaf in the opening direction of the overstriking door leaf regardless if the braking means is in the non-braking state or the braking state.

In one aspect, the first controlling means (403) is arranged to separate the braking means (401, 402) from the brake drum (407). The first controlling means (403) is arranged to separate the braking means (401, 402) from the brake drum (407) in the non-braking position of the first controlling means (403). In one aspect, the first controlling means (403) is arranged to not affect the braking means (401, 402) in the braking position of the first controlling means (403).

In one aspect, the second controlling means (404) is arranged to separate the braking means (401, 402) from the brake drum (407). The second controlling means (404) is arranged to separate the braking means (401, 402) from the brake drum (407) in the non-braking position of the second controlling means (404). In one aspect, the second controlling means (404) is arranged to not affect the braking means (401, 402) in the braking position of the second controlling means (404).

In the non-braking state of the braking means (401, 402) either the first controlling means (403) or the second controlling means (404) separates the braking means (401, 402) from the brake drum (407).

In one aspect, the braking means (401, 402) comprises a brake lining (408, 409). The brake lining (408, 409) may be continuous or in one or several sections. The brake lining (408, 409) may cover the complete circumference of the brake drum (407) or portions of the circumference of the brake drum (407). The brake lining (408, 409) may cover the complete inner circumference of the brake drum (407) or portions of the inner circumference of the brake drum (407). The brake lining (408, 409) abuts the brake drum (407) during braking.

In one aspect, the mechanical brake arrangement comprises two braking means (401, 402). In one aspect, the first controlling means (403) is arranged to control the braking of both of said two braking means (401, 402). In one aspect, the second controlling means (404) is arranged to control the braking of both of said two braking means (401, 402).

As seen in the embodiment in the FIGS. 6-10, in the non-braking position of the first controlling means (403), the first controlling means (403) presses the two braking means (401, 402) together. Thereby, the first controlling means (403) separates the two braking means (401, 402) from the brake drum (407). In the non-braking position of the second controlling means (404), the second controlling means (404) presses the two braking means (401, 402) together. Thereby, the second controlling means (404) separates the two braking means (401, 402) from the brake drum (407).

In one aspect, the mechanical brake arrangement (400) comprises a support structure (410). The braking means (401, 402) may be connected to the support structure (410). The braking means (401, 402) may be pivotably attached to the support structure (410). The pivot pin (415, 416) of the braking means may be arranged on the support structure (410). The pivot pin (415, 416) of the braking means (401, 402) is parallel to the center axis of the brake drum (407). The pivot axis (413, 414) of the braking means (401, 402) is parallel to the center axis of the brake drum (407).

In one aspect, the braking means (401, 402) abuts a brake support means (419) in an axial direction of the brake drum (407). Thereby, the braking means (401, 402) is stabilized in the axial direction. The lever portion (411, 412) of the braking means (401, 402) may abut the brake support means (419) in the axial direction of the brake drum (407). The support structure (410) may comprise the support means (419). The brake support means (419) may be a portion of the support structure (410).

The first control lever (421) may be connected to the support structure (410). The first control lever (421) may be pivotably attached to the support structure (410). The first control lever (421) may comprise a first control pivot axis (423) about which the first control lever (421) pivots. The first controlling means (403) may act on the braking means (401, 402) by pivoting the first control lever (421) about the first control pivot axis (423). The first control pivot axis (423) may be perpendicular to the center axis (420) of the brake drum (407).

The first control lever (421) may be connected to the support structure (410) by means of a first control pivot pin (425), about which first control pivot pin (425) the first control lever (421) pivots. The first control lever (421) may comprise a first control pivot portion (427) to which the first control pivot pin (425) is connected. The first control pivot axis (423) coincides with the longitudinal direction of the first control pivot pin (425).

The second control lever (422) may be connected to the support structure (410). The second control lever (422) may be pivotably attached to the support structure (410). The second control lever (422) may comprise a second control pivot axis (424) about which the second control lever (422) pivots. The second controlling means (404) may act on the braking means (401, 402) by pivoting the second control lever (422) about the second control pivot axis (424). The second control pivot axis (424) may be perpendicular to the center axis (420) of the brake drum (407).

The second control lever (422) may be connected to the support structure (410) by means of a second control pivot pin (426), about which second control pivot pin (426) the second control lever (422) pivots. The second control lever (422) may comprise a second control pivot portion (428) to which the second control pivot pin (426) is connected. The second control pivot axis (424) coincides with the longitudinal direction of the second control pivot pin (426). The second control pivot axis (424) may coincide with the first control pivot axis (423). The first control pivot pin (425) and the second control pivot pin (426) may be devised as a common control pin (425, 426).

The first control lever (421) may abut a first control support means (429). Thereby, the first control lever is supported and stabilized. The first control lever (421) may abut the first control support means (429) at a distance from the first control pivot axis (423). The support structure (410) may comprise the first control support means (429).

The second control lever (422) may abut a second control support means (430). Thereby, the second controlling means is supported and stabilized. The second control lever (422) may abut the second control support means (430) at a distance from the second control pivot axis (424). The support structure (410) may comprise the second control support means (430).

The first control lever (421) and the second control lever (422) may abut each other. The first control lever (421) and the second control lever (422) may abut each other at a distance from the first control pivot axis (423) and/or at a distance from the second control pivot axis (424).

In one aspect, the first controlling means (403) comprises an inclined surface that engages the braking means (401, 402) such that the braking means (401, 402) is pushed away from the brake drum (407). Thereby, the braking means (401, 402) is separated from the brake drum (407) and thus the braking action of the braking means (401, 402) is removed. The inclined surface of the first controlling means (403) engages the lever portion (411, 412) of the braking means (401, 402). The inclined surface of the first controlling means (403) abuts the braking means (401, 402) and pushes the braking means (401, 402) away from the brake drum (407).

In one aspect, the second controlling means (404) comprises an inclined surface that engages the braking means (401, 402) such that the braking means (401, 402) is pushed away from the brake drum (407). Thereby, the braking means (401, 402) is separated from the brake drum (407) and thus the braking action of the braking means (401, 402) is removed. The inclined surface of the second controlling means (404) engages the lever portion (411, 412) of the braking means (401, 402). The inclined surface of the second controlling means (404) abuts the braking means (401. 402) and pushes the braking means (401, 402) away from the brake drum (407).

In one aspect, the mechanical brake arrangement (400) comprises two braking means (401, 402). The first controlling means (403) may be arranged to push said two braking means (401, 402) towards each other. The first controlling means (403) may comprise two inclined surfaces together forming a first forked engagement portion. The first forged engagement portion may engage the braking means (401, 402) such that the braking means (401, 402) are pushed away from the brake drum (407). Each of the two inclined surfaces of the first forged engagement portion may engage one of the two braking means such that both of the two braking means are pushed away from the brake drum.

The second controlling means (404) may be arranged to push said two braking means (401, 402) towards each other. The second controlling means (404) may comprise two inclined surfaces together forming a second forked engagement portion. The second forged engagement portion may engage the braking means (401, 402) such that the braking means (401, 402) are pushed away from the brake drum (407). Each of the two inclined surfaces of the second forged engagement portion may engage one of the two braking means such that both of the two braking means are pushed away from the brake drum.

The inclined surface implies that the braking force of the braking means can be controlled by controlling how far in on the inclined surface of the controlling means the braking means is engaged.

As an alternative to, or in combination with, the inclined surface of the first and/or second controlling means, the braking means may have an inclined surface where the first and/or second controlling means acts on the braking means, such as at the lever portion of the first and/or second controlling means. Thereby, the braking force of the braking means can be controlled by controlling how far in on the inclined surface of the braking means the controlling means engages the braking means.

The control of the braking force can be step wise or continuous by adapting the profile of the inclined surface.

In one aspect of a mechanical brake arrangement comprising two braking means, the brake spring (405) pushes the two braking means (401, 402) apart. Thus, the brake spring (405) pushes the two braking means (401, 402) away from each other. The brake spring (405) may be arranged between the two braking means (401, 402). The brake spring (405) is then typically a compression spring (405).

In one aspect of a mechanical brake arrangement comprising two braking means, the first controlling means (403) is arranged to act on the two braking means (401, 402) such that the two braking means (401, 402) are pushed towards each other. Thereby, the brake spring (405) is compressed.

In one aspect of a mechanical brake arrangement comprising two braking means, the second controlling means (404) is arranged to act on the two braking means (401, 402) such that the two braking means (401, 402) are pushed towards each other. Thereby, the brake spring (405) is compressed.

In one embodiment, the first door operator (11) is further adapted to move the understriking door leaf (2) between a closed and an open position and the second door operator (12) is further adapted to move the overstriking door leaf (3) between a closed and an open position.

As stated above, the present invention also relates to a mechanical brake arrangement (400) for controlling the movement of one of the door leafs of a double door system comprising an understriking door leaf (2) and an overstriking door leaf (3), where the understriking door leaf (2) should be closed before the overstriking door leaf (3) to close the double door, wherein the mechanical brake arrangement (400) is adapted to brake the movement of the overstriking door leaf (3), and wherein the mechanical brake arrangement (400) comprises a brake drum (407) adapted to be connected to overstriking door leaf (3), a braking means (401, 402) arranged to interact with the inside of the brake drum (407), and a first controlling means (403), which is mechanically operated and arranged to control the braking of the braking means (401, 402) in relation to the position of the understriking door leaf (2).

The mechanical brake arrangement has the same function and advantages as detailed above for the double door system. The mechanical brake arrangement may also have the same additional features and function and advantages related thereto as the additional features presented above.

As stated above, the present invention also relates to a door operator system (10) comprising a first door operator (11) adapted to move an understriking door leaf (2) between an open and a closed position, a second door operator (12) adapted to move an overstriking door leaf 10 (3) between an open and a closed position and a mechanical brake arrangement according to above.

The door operator system also has the same function and advantages as detailed above for the double door system. The door operator system may also have the same additional features and function and advantages related thereto as the additional features presented above.

The operation of the invention is explained below.

The operation of a double door having a first controlling means (403) but no second controlling means as defined herein is explained as follows.

When the understriking door leaf (2) is open, the understriking door leaf (2) is in its opened condition. Then the first controlling means (403) is in its braking position. The braking means (401, 402) is then in its braking state (since the first controlling means is in its braking position and the braking means thereby abuts the drum). Thus, the movement of the overstriking door leaf (3) is braked in the closing direction.

When the understriking door leaf (2) is moved into its closed condition, the first controlling means (403) is moved into its non-braking position. Then the first controlling means (403) is in its non-braking position. The braking means (401, 402) is then in its non-braking state (since the first controlling means is in its non-braking position and the braking means thereby is separated from the drum). Thus, the overstriking door leaf (3) is allowed to move in the closing direction. Thereby, the double door is closed properly.

The operation of the double door having a first controlling means (403) and a second controlling means (404) is explained as follows.

When both the understriking door leaf (2) and the overstriking door leaf (3) are fully opened, the understriking door leaf (2) is in its opened condition and the overstriking door leaf (3) is in its first opened state, i.e. the angle α is larger than the predetermined value. Then the first controlling means (403) is in its braking position and the second controlling means (404) is in its non-braking position. The braking means (401, 402) is then in its non-braking state (since at least one of the controlling means is in its non-braking position and the braking means thereby is separated from the drum). Thus, the overstriking door leaf (3) is allowed to move in the closing direction. There is no risk that the overstriking door leaf will block the closing of the understriking door leaf as long as the overstriking door leaf is in its first opened state.

In case the overstriking door leaf (3) is moved into its second opened state, i.e. the overstriking door leaf (3) is moved to a position where the angle α is equal to the predetermined angle, when the understriking door leaf (2) still is in its opened condition, then the first controlling means (403) is still in its braking position and the second controlling means (404) is moved into its braking position. The braking means (401, 402) is then in its braking state (since both of the controlling means is in their braking position and the braking means thereby abuts the drum). Thus, the movement of the overstriking door leaf (3) is braked in the closing direction. The overstriking door leaf (3) will be held at an angle α equal to the predetermined angle until the understriking door leaf (2) has reached its closed condition in order to avoid that the overstriking door leaf (3) blocks the closing movement of the understriking door leaf (2).

When the understriking door leaf (2) is moved into its closed condition, the first controlling means (403) is moved into its non-braking position. The overstriking door leaf (3) is still in its second opened state, i.e. the overstriking door leaf (3) is in a position where the angle α is equal to the predetermined angle. Then the first controlling means (403) is in its non-braking position and the second controlling means (404) is still in its braking position. The braking means (401, 402) is then in its non-braking state (since at least one of the controlling means is in its non-braking position and the braking means thereby is separated from the drum). Thus, the overstriking door leaf (3) is allowed to move in the closing direction. Thereby, the double door is closed properly.

In case the understriking door leaf (2) instead reaches its closed condition when the overstriking door leaf still is in its first opened state, i.e. the angle α is larger than the predetermined value, then the first controlling means (403) is moved into its non-braking position and the second controlling means (404) is still in its in its non-braking position. The braking means (401, 402) is then in its non-braking state (since at least one, at this point both, of the controlling means is in its non-braking position and the braking means thereby is separated from the drum). Thus, the overstriking door leaf (3) is allowed to move in the closing direction.

When the overstriking door leaf (3) is moved into its second opened state, i.e. the overstriking door leaf (3) is moved to a position where the angle α is equal to or smaller than the predetermined angle, the second controlling means (404) is moved into its braking position. The understriking door leaf (2) still is in its closed condition and then the first controlling means (403) is still in its non-braking position and. The braking means (401, 402) is then in its non-braking state (since at least one of the controlling means is in its non-braking position and the braking means thereby is separated from the drum). Thus, the overstriking door leaf (3) is allowed to move in the closing direction. Thereby, the double door is closed properly.

The movement of the first controlling means based on the position of the understriking door leaf is explained as follows.

When the understriking door leaf (2) is opened, i.e. moved to its opened condition, e.g. by means of the first motor (21) and the first door operator arm (31) or by hand, the first spring rod (15) is moved in the opposite direction of the second door operator (12). By movement of the first spring rod (15), a first end (15*a*) of the first spring rod (15) compresses the first spring (17). By movement of the first spring rod (15), the first position transferring means (19) connected to the first spring rod (15) is moved in same direction as the first spring rod (17). Thereby the first controlling means (403), which is connected to the first position transferring means (19), is moved in the same direction as the first position transferring means (19) and into its braking position, where the first controlling means (403) does not affect the braking means (401, 402).

When the understriking door leaf (2) is closed, i.e. moved to its closed condition, e.g. by means of a spring load stored in the first spring (17) during compression of the first spring (17), the first spring rod (15) is moved in the direction of the second door operator (12). Thereby, the first position transferring means (19) connected to the first spring rod (15) is moved in the same direction. Thereby the first controlling means, which is connected to the first position transferring means (19), is moved in the same direction and into its non-braking position, where the first controlling means (403) separates the braking means (401, 402) from the drum (407).

The movement of the second controlling means based on the position of the overstriking door leaf is explained as follows.

When the overstriking door leaf (3) is moved into its first opened state, i.e. into a position where the angle α is larger than the predetermined angle, e.g. by means of the second motor (22, 23) and the second door operator arm (32) or by hand, the second spring rod (16) is moved in the opposite direction of the first door operator (11). By movement of the second spring rod (16), a first end (16*a*) of the second spring rod (16) compresses the second spring (18). By movement of the second spring rod (16), the second controlling means, which is connected to the second spring rod (16), is moved in the same direction as the second spring rod (16) and into its non-braking position, where the second controlling means (404) separates the braking means (401, 402) from the drum (407).

When the overstriking door leaf (3) is moved into its second opened state, i.e. into a position where the angle α is equal to or smaller than the predetermined angle, e.g. by means of a spring load stored in the second spring (18) during compression of the second spring (18), the second spring rod (16) is moved in the direction of the first door operator (11). Thereby the second controlling means, which is connected to the second spring rod (16), is moved in the same direction as the second spring rod (16) and into its braking position, where the second controlling means (404) does not affect the braking means (401, 402).

The foregoing has described the principles, preferred embodiments and aspects and modes of operation of the present invention. However, the description should be regarded as illustrative rather than restrictive, and the invention should not be limited to the particular embodiments and aspects discussed above. The different features of the various embodiments and aspects of the invention can be combined in other combinations than those explicitly described. It should therefore be appreciated that variations may be made in those embodiments and aspects by those skilled in the art without departing from the scope of the present invention as defined by the following claims.

The invention claimed is:

1. A double door system comprising an understriking door leaf, an overstriking door leaf, a first door operator adapted to move the understriking door leaf between an open and a closed position, a second door operator adapted to move the overstriking door leaf between an open and a closed position and a mechanical brake arrangement, wherein the understriking door leaf should be closed before the overstriking door leaf to close the double door, and wherein the mechanical brake arrangement is arranged to brake the movement of the overstriking door leaf and comprises a brake drum connected to the second door operator, wherein the brake drum rotates in response to the movement of the overstriking door, a braking means arranged to interact with the inside of the brake drum, wherein the braking means comprises a braking portion located radially inwards of the brake drum and movable radially outwards onto the brake drum to apply braking, and a first controlling means, which is mechanically operated and arranged to control the braking of the braking means in relation to the position of the understriking door leaf.

2. The double door system according to claim 1, wherein the braking means comprises a lever portion extending radially outside of the brake drum, on which lever portion the first controlling means acts.

3. The double door system according to claim 1, wherein the braking means comprises a pivot axis about which the braking means pivots, wherein the pivot axis is located radially outside of the brake drum.

4. The double door system according to claim 1, wherein the mechanical brake arrangement is operable in a powerless condition.

5. The double door system according to claim 1, wherein the first controlling means is arranged to put the braking means in a non-braking state when the understriking door leaf is in the closed position.

6. The double door system according to claim 1, wherein the first controlling means is arranged to put the braking means in a braking state when the understriking door leaf is in an opened condition.

7. The double door system according to claim 1, wherein the mechanical brake arrangement comprises a second controlling means, which is mechanically operated and arranged to control the braking of the braking means in relation to the position of the overstriking door leaf.

8. The double door system according to claim 7, wherein the second controlling means is arranged to put the braking means in a non-braking state when the overstriking door leaf is in a first opened state, which first opened state corresponds to a position of the overstriking door leaf having an angle (a) in relation to the closed position of the overstriking door leaf that is larger than a predetermined angle.

9. The double door system according to claim 8, wherein the first controlling means and the second controlling means are arranged to put the braking means in a braking state when the understriking door leaf is in an opened condition and the overstriking door leaf is in a second opened state, which second opened state corresponds to a position of the overstriking door leaf having an angle (a) in relation to the closed position of the overstriking door leaf that is equal to or smaller than said predetermined angle.

10. A mechanical brake arrangement for controlling the movement of one of the door leafs of a double door system comprising an understriking door leaf and an overstriking door leaf, where the understriking door leaf should be closed before the overstriking door leaf to close the double door, wherein the mechanical brake arrangement is adapted to brake the movement of the overstriking door leaf, and wherein the mechanical brake arrangement comprises a brake drum adapted to be connected to the overstriking door leaf, wherein the brake drum rotates in response to the movement of the overstriking door, a braking means arranged to interact with an inside surface of the brake drum, wherein the braking means comprises a braking portion located radially inwards of the brake drum and movable radially outwards onto the brake drum to apply braking, and a first controlling means, which is mechanically operated and arranged to control the braking of the braking means in relation to a position of the understriking door leaf.

11. The mechanical brake arrangement according to claim 10, wherein the braking means comprises a lever portion extending radially outside of the brake drum, on which lever portion the first controlling means acts.

12. The mechanical brake arrangement according to claim 10, wherein the braking means comprises a pivot axis about which the braking means pivots, wherein the pivot axis is located radially outside of the brake drum.

13. The mechanical brake arrangement according to claim 10, wherein the mechanical brake arrangement is operable in a powerless condition.

14. The mechanical brake arrangement according to claim 10, wherein the first controlling means is arranged to put the braking means in a non-braking state when the understriking door leaf is in a closed position.

15. The mechanical brake arrangement according to claim 10, wherein the first controlling means is arranged to put the braking means in a braking state when the understriking door leaf is in an opened condition.

16. The mechanical brake arrangement according to claim 10, wherein the mechanical brake arrangement comprises a second controlling means, which is mechanically operated and arranged to control the braking of the braking means in relation to a position of the overstriking door leaf.

17. The mechanical brake arrangement according to claim 16, wherein the second controlling means is arranged to put the braking means in a non-braking state when the overstriking door leaf is in a first opened state, which first opened state corresponds to a position of the overstriking door leaf having an angle (a) in relation to a closed position of the overstriking door leaf that is larger than a predetermined angle.

18. The mechanical brake arrangement according to claim 17, wherein the first controlling means and the second controlling means are arranged to put the braking means in a braking state when the understriking door leaf is in an opened condition and the overstriking door leaf is in a second opened state, which second opened state corresponds to a position of the overstriking door leaf having an angle (a) in relation to a closed position of the overstriking door leaf that is equal to or smaller than said predetermined angle.

19. A door operator system comprising a first door operator adapted to move an understriking door leaf between an open and a closed position, a second door operator adapted to move an overstriking door leaf between an open and a closed position and the mechanical brake arrangement according to claim 10.

* * * * *